United States Patent [19]

Martin

[11] Patent Number: 4,915,155

[45] Date of Patent: Apr. 10, 1990

[54] INTEGRAL CASTING FLASK AND VACUUM CHAMBER

[76] Inventor: Richard A. Martin, 105 N. Union St., Alexandria, Va. 22314

[21] Appl. No.: 266,581

[22] Filed: Nov. 3, 1988

[51] Int. Cl.[4] ..... B22C 21/00

[52] U.S. Cl. ..... 164/255; 164/374; 164/376

[58] Field of Search ..... 164/62, 63, 65, 254, 164/255, 374, 376

[56] References Cited

U.S. PATENT DOCUMENTS

| | | | |
|---|---|---|---|
| 1,429,322 | 9/1922 | Brophy | 164/376 |
| 1,473,278 | 11/1923 | Burns | 164/374 |
| 1,490,090 | 4/1924 | Burns | 164/376 |
| 3,705,615 | 12/1972 | Watts | 164/255 |
| 3,780,787 | 6/1971 | Rasmussen | 164/376 |
| 3,800,851 | 4/1974 | Coghill | 164/255 |
| 3,955,612 | 5/1976 | Schultheiss | 164/255 |
| 4,781,237 | 11/1988 | Sing | 164/255 |

*Primary Examiner*—Richard K. Seidel

*Attorney, Agent, or Firm*—Sherman and Shalloway

[57] ABSTRACT

An integral casting flask/vacuum chamber combination is disclosed in which an inner tube forming the casting flask is disposed coaxially inside of an outer tube thus forming a vacuum chamber between the two tubes. The inner tube has holes formed in its circumference to provide for uniform evacuation of air from the investment for pulling the casting material into the mold. A shoulder portion integrally connects the inner tube with the outer tube in such a way that the bottom edge of the inner tube is suspended above the bottom edge of the outer tube and the top edge of the inner tube is suspended above the top edge of the outer tube. This device is used in combination with a vacuum table and does not require the complex and expensive conventional vacuum chamber.

13 Claims, 1 Drawing Sheet

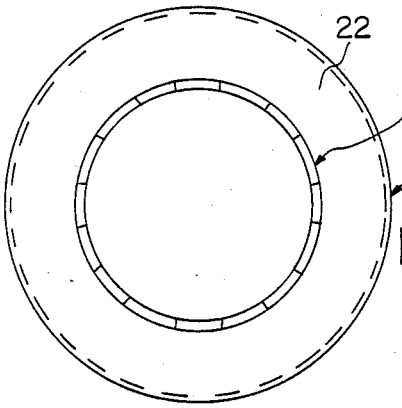
FIG.3
FIG.1
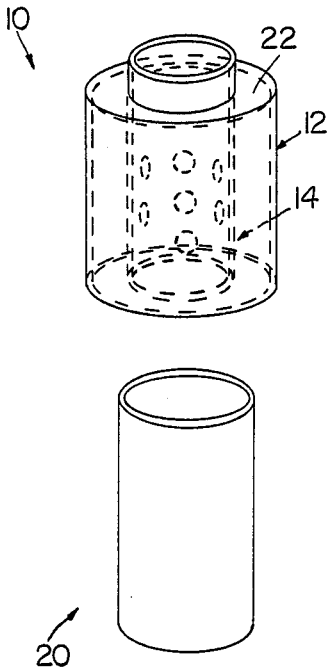
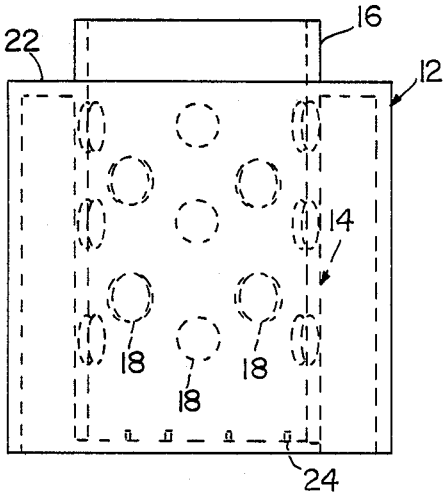
FIG.2
FIG.4

INTEGRAL CASTING FLASK AND VACUUM CHAMBER

BACKGROUND OF THE INVENTION

1. Field of the Invention

The present invention relates generally to a device for use in vacuum casting and more specifically to a combination vacuum chamber and casting flask. This device is used in the process known as the lost wax method for producing precision castings which is often used in the dental and jewelry fields. This process begins with the pouring of an investment slurry into a flask which contains a wax model of the desired end product. Once the slurry has hardened, the flask and investment are subject to a burn-out treatment to thereby burn away the wax model. The flask is placed over a vacuum source in order to pull air through the hardened investment. Molten metal is then poured into the void left by the wax model, and is pulled into extreme portions of the void. The molten metal is then allowed to solidify and cool.

2. Description of the Prior Art

Various types of casting flasks have been proposed in the prior art. For example, in U.S. Pat. No. 1,429,322 to Brophy, a casting flask is provided with holes in its side walls to thereby aid in the drying and burning out and heating of the investment compound. A sleeve is provided to slide over the flask so as to allow the investment slurry to be poured into the flask without pouring out through the holes. U.S. Pat. Nos. 1,473,278 and 1,490,090 to Burns disclose receptacles to hold different sized casting flasks. U.S. Pat. No. 3,780,787 to Rasmussen discloses a method of vacuum investment casting in which the investment is removed from the flask before molten metal is poured therein. The investment is cast with a shoulder portion which rests upon the upper edge of a vacuum chamber during vacuuming. The book by Murray Bovin entitled "Centrifugal or Lost Wax Jewelry Casting" discloses at pages 80–81, FIGS. 180–181, a prior art vacuum casting machine. This machine is very large and is prohibitively expensive for the small businessman. It also has the disadvantage that in its use, the casting flask is cooled considerably, first, because it is initially outside of the chamber and subject to ambient air, and secondly, because the chamber is much larger than the flask and thus a longer time is required in forming the vacuum which itself rapidly cools the flask.

While each of these prior inventions has contributed to the casting process to various extents, there remains a need to improve upon the evacuation of air from the investment to thereby uniformly pull the molten metal into the mold. There is also a need to speed the vacuum process so as to cause less cooling of the flask. This cooling of the flask occurs at the rate of approximately 100° F. for every minute it is exposed to the ambient air. Furthermore, the vacuum chamber and associated apparatus are often prohibitively expensive for the small businessman.

SUMMARY OF THE INVENTION

In accordance with the present invention, a casting flask is provided which is integrally connected with and disposed within its own vacuum chamber. This casting flask/vacuum chamber combination comprises an outer tube, an inner tube with holes provided therein spaced about its circumference, and a ring shaped shoulder which is connected at its outer edge integrally with the upper edge of the outer tube and at its inner edge with an intermediate portion of the inner tube. The inner tube is suspended by way of the shoulder within the outer tube such that the bottom edge of the inner tube is spaced above the bottom edge of the outer tube and such that the upper edge of the inner tube is spaced above the upper edge of the outer tube.

This device has proven to be very helpful in the making of fine jewelry and other castings because no separate vacuum chamber is necessary. Rather, only a vacuum table (a machine which has a flat surface with a hole or holes through which air is pulled downwardly) is required upon which the device is placed to thereby obtain a uniform vacuum below and around the sides of the investment. Once the molten metal is poured, the openings in the inner tube allow the vacuum to pull air from outside of the investment to thereby pull the metal into crevices in the mold. Items cast in prior art casting flasks often ended up with small or large metal balls called nodules clinging to the castings. The present invention has proven to provide superior castings with virtually no defects.

Additional feature,, objects and advantages of the invention will become apparent from the drawings and the following detailed description.

BRIEF DESCRIPTION OF THE DRAWING FIGURES

FIG. 1 is a perspective view of the combination vacuum chamber and casting flask according to the present invention;

FIG. 2 is a front view of a combination vacuum chamber and casting flask according to the present invention;

FIG. 3 is a plan view of FIG. 2; and

FIG. 4 is a perspective view of a sleeve used to cover the holes in the inner tube during pouring of investment slurry.

DETAILED DESCRIPTION OF THE INVENTION

The casting flask/vacuum chamber combination according to the present invention is shown at 10. The casting flask portion of the invention comprises an inner tube 14 and the vacuum chamber portion of the invention comprises an outer tube 12 and a shoulder portion 22. These components are integrally formed as a single unit.

Inner tube 14 is open at both of its ends and includes holes 18 spaced about its circumference. Small slots 24 are provided in the periphery of the bottom edge of the inner tube and are spaced equally about the circumference. Outer tube 12 is open at its bottom end but closed at its top end by shoulder portion 22. Shoulder 22 is attached in a manner, such as by welding, so as to be integral with the upper edge of the outer tube and also with an intermediate portion of the inner tube and so as to provide an air impermeable chamber when sealed at the bottom. The inner tube is suspended by the shoulder portion such that its bottom edge is spaced above the bottom edge of the outer tube and its upper edge is spaced above the upper edge of the outer tube.

Holes 18 provide a means for a vacuum to pull air through the investment within the casting flask 14 immediately during pouring of the molten metal so as to pull metal into every crevice of the void left by the burnt out wax model. The bottom edge of the inner tube is spaced above the bottom edge of the outer tube so that when the device is placed on a vacuum table, a uniform vacuum is formed at the bottom of the flask and about the sides of the flask. When placed on the vacuum table, the device is disposed on a mat such as a silicone mat. Slots 24 are a precautionary measure in case the mat lodges itself against the bottom periphery of the inner tube. If this occurs, the slots 24 will still allow a uniform vacuum to form about the flask. Upper portion 16 of the inner tube protrudes above the outer tube and provides a lip onto which a sealing cap, which includes a sprue former therein, is placed. The device with the sealing cap thereon is turned upside down so that the investment slurry can be poured therein from the bottom.

The vacuuming procedure causes rapid cooling of the flask which is harmful to the overall casting. Thus, it is desirable to keep the amount of time in vacuum conditions to a minimum. This is accomplished in the present invention because the spacing between the inner and outer tubes is relatively narrow and thus, the vacuum takes less time to form than in conventional vacuum chambers. Although various sizes of the casting flask/vacuum chamber device are required for different sized castings, a preferred embodiment of the device is where the overall height of the device is 4.125 inches wherein the outer tube height is 3.5 inches and the inner tube height is 4 inches with a spacing between the bottom edges of the two tubes being 0.125 inches. The inner tube has an outside diameter of 2.5 inches and the outer tube has an inside diameter of 3.25 inches thus leaving a spacing between each tube of only 0.375 inches. Preferably, the material for the device is stainless steel, however, it can be formed of any material commonly used in casting flasks. The stainless steel material can be of any thickness, but in the preferred embodiment is about 0.125 inches.

An elastomeric sleeve 20 is provided and is inserted over the inner tube to thereby block holes 18 during pouring of the investment slurry. As shown in FIG. 4, the sleeve is of a diameter to snugly fit over the inner tube 14 and is of a thickness so as to not interfere with the outer tube 12 and to be readily removed therefrom after the investment has set. The sleeve has a length such that when it is fully inserted into the vacuum chamber space between the inner tube and outer tube, it extends below the bottom edge of the outer tube to thereby provide an extension of the flask to keep the investment slurry from leaking out. Furthermore, the upper edge of the sleeve is formed with sealing ridges so as to form a seal when inserted in the space between the inner and outer tubes.

The present invention provides a very simple means for casting jewelry and the like as compared to the conventional vacuum chamber methods. Furthermore, this device is easily afforded by the small businessman unlike the conventional large vacuum chamber devices. Furthermore, with the flask being integral and inside of the vacuum chamber, it is, in effect, insulated during the entire procedure from the outside ambient air. The space between the inner and outer tubes acts as an insulator and thereby causes slower cooling and, thus, a better casting.

Many variations of the embodiment disclosed may be made without departing from the spirit and scope of the invention. It is to be understood therefore, that this invention is not to be limited to the disclosed embodiment except as defined in the appended claims.

What is claimed is:

1. A casting flask and vacuum chamber unit comprising:

an inner tube having a bottom opening and a circumferential sidewall, said circumferential sidewall having a top edge and a bottom edge, said inner tube forming a casting flask portion;

an outer tube having a bottom opening and a circumferential sidewall, said circumferential sidewall having a top edge and a bottom edge;

said bottom opening of said circumferential sidewall of said inner tube having a diameter extending between diametrically opposite points on said bottom edge of said circumferential sidewall of said inner tube;

said bottom opening of said circumferential sidewall of said outer tube having a diameter extending between diametrically opposite points on said bottom edge of said circumferential sidewall of said outer tube; and a ring shaped shoulder being integrally and nonremovably connected to each of said inner and outer tubes and having an inner edge and an outer edge, said inner edge of said shoulder being fixedly attached to said circumferential sidewall of said inner tube intermediate said top and bottom edges of said circumferential sidewall of said inner tube, said outer edge of said shoulder being fixedly attached to said circumferential sidewall of said outer tube at said top edge of said circumferential sidewall of said outer tube.

2. A casting flask and vacuum chamber combination as recited in claim 1, wherein said inner tube has an air-permeable circumferential wall for allowing uniform evacuation of air therethrough.

3. A casting flask and vacuum chamber combination as recited in claim 2, wherein said inner tube extends above the top edge of said outer tube.

4. A casting flask and vacuum chamber combination as recited in claim 2, wherein said inner tube has holes therein spaced about its circumferential wall.

5. A casting flask and vacuum chamber combination as recited in claim 1, wherein said inner tube extends above the top edge of said outer tube.

6. A casting flask and vacuum chamber combination as recited in claim 5, wherein the distance between the inner and outer tubes is less than the inside radius of the inner tube.

7. A casting flask and vacuum chamber combination as recited in claim 1, wherein the bottom edge of said inner tube is spaced above the bottom edge of said outer tube.

8. A casting flask and vacuum chamber unit as recited in claim 1, wherein said circumferential sidewall of said inner tube has radial openings therein spaced about its circumference.

9. A casting flask and vacuum chamber combination as recited in claim 8, further comprising means for blocking said openings during pouring of investment slurry into said inner tube.

10. A casting flask and vacuum chamber combination comprising, an outer tube having a top edge and a bottom edge;

an inner tube having a top edge, a bottom edge and openings therein spaced about its circumference, and including a bottom opening which extends across an entire inner diameter of said inner tube such that said bottom edge is a free edge;

a ring shaped shoulder having an inner and an outer edge, integrally connected at its outer edge to the top edge of said outer tube and integrally connected at its inner edge to said inner tube;

wherein the bottom edge of said inner tube is spaced above the bottom edge of said outer tube and has short longitudinal slots formed therein to provide air passage if said bottom opening of said inner tube is blocked.

11. A casting flask and vacuum chamber combination as recited in claim 10, wherein said inner edge of said shoulder is connected to said inner tube intermediate its top and bottom edges.

12. A casting flask and vacuum chamber combination as recited in claim 11, wherein the distance between the inner and outer tubes is less than the inside radius of the inner tube.

13. A casting flask and vacuum chamber combination comprising, an inner tube, having a top edge, a bottom edge and a bottom opening and which forms a casting flask;

an outer tube having a top edge and a bottom edge; and means integrally and non-removably connected to each of said inner and outer tubes for suspending said inner tube coaxially within said outer tube with the bottom edge of said inner tube being spaced above the bottom edge of said outer tube, such that the inner and outer tubes form a single integral unit;

said bottom opening of said inner tube extending across an entire inner diameter of said inner tube such that said bottom edge of said inner tube is a free edge and said bottom edge of said inner tube having short longitudinal slots formed therein to provide air passage if said bottom opening of said inner tube is blocked.

* * * * *